US008408032B2

(12) United States Patent
Felkl et al.

(10) Patent No.: US 8,408,032 B2
(45) Date of Patent: Apr. 2, 2013

(54) CONTROLLING ARRANGEMENT FOR A ROLLING STAND AND ITEMS CORRESPONDING THERETO

(75) Inventors: Hans-Joachim Felkl, Forchheim (DE); Dietrich Wohld, Rauschenberg (DE)

(73) Assignee: Siemens Aktiengesellschaft, Munich (DE)

( * ) Notice: Subject to any disclaimer, the term of this patent is extended or adjusted under 35 U.S.C. 154(b) by 722 days.

(21) Appl. No.: 12/523,552

(22) PCT Filed: Jan. 21, 2008

(86) PCT No.: PCT/EP2008/050615
§ 371 (c)(1),
(2), (4) Date: Jul. 17, 2009

(87) PCT Pub. No.: WO2008/090112
PCT Pub. Date: Jul. 31, 2008

(65) Prior Publication Data

US 2010/0005844 A1 Jan. 14, 2010

(30) Foreign Application Priority Data

Jan. 23, 2007 (DE) ..... 10 2007 003 243

(51) Int. Cl.
*B21B 37/58* (2006.01)
*G06F 19/00* (2006.01)

(52) U.S. Cl. ..... 72/10.4; 72/10.7; 72/10.3; 700/156

(58) Field of Classification Search ..... 72/10.1, 72/10.4, 10.7, 241.2, 241.4, 241.6, 241.8, 72/10.3, 365.2, 245; 700/156
See application file for complete search history.

(56) References Cited

U.S. PATENT DOCUMENTS 3,543,549 A 12/1970 Howard
3,920,968 A 11/1975 Imai et al.
(Continued)

FOREIGN PATENT DOCUMENTS

DE 2430089 A1 1/1975
DE 2643686 A1 3/1978
(Continued)

OTHER PUBLICATIONS

International Search Report, PCT/EP2008/050615, 11 pages, May 23, 2008.

(Continued)

*Primary Examiner* — Dana Ross
*Assistant Examiner* — Mohammad I Yusuf
(74) *Attorney, Agent, or Firm* — King & Spalding L.L.P.

(57) ABSTRACT

A regulation device (7) for a rolling stand (2) has a force regulator (8) and a position regulator (9) mounted underneath the force regulator. During operation of the regulation device, a rolling force target value (F*) and a rolling force actual value (F) are supplied to the force regulator (8). A regulating distance correcting value (ds1*) is determined by the force regulator (8) from the rolling force target value (F*) and the rolling force actual value (F). The regulating distance correcting value (ds1*), an excentricity compensation value (ds2*), and a regulating distance actual value (s) of a regulating element (6) are supplied to the position regulator (9). A correcting quantity (dq) is determined by the position regulator (9) from the values (ds1*, ds2*, s) supplied thereto and is delivered to the regulating element (6). The regulating distance of the regulating element (6) is changed according to the correcting quantity (dq).

12 Claims, 2 Drawing Sheets

U.S. PATENT DOCUMENTS

| | | | | |
|---|---|---|---|---|
| 4,580,224 | A | 4/1986 | Gerber | 364/472 |
| 4,685,063 | A * | 8/1987 | Weihrich et al. | 72/10.4 |
| 5,077,997 | A | 1/1992 | Wolters et al. | 72/8 |
| 5,600,982 | A * | 2/1997 | Berger | 72/10.1 |

FOREIGN PATENT DOCUMENTS

| | | | |
|---|---|---|---|
| DE | 3423656 | A1 | 2/1985 |
| DE | 3925104 | A1 | 2/1990 |
| DE | 3935434 | A1 | 5/1991 |
| DE | 4411313 | A1 | 11/1994 |
| DE | 19834758 | A1 | 2/2000 |
| EP | 0170016 | A1 | 6/1985 |
| GB | 1580066 | | 11/1980 |
| JP | 56119613 | A | 9/1981 |
| RU | 2124405 | C1 | 1/1999 |

OTHER PUBLICATIONS

Huzyak, et al., "Design and application of hydraulic gap control systems", AISE Year Book, pp. 331-337, 1984.

* cited by examiner

CONTROLLING ARRANGEMENT FOR A ROLLING STAND AND ITEMS CORRESPONDING THERETO

CROSS-REFERENCE TO RELATED APPLICATIONS

This application is a U.S. National Stage Application of International Application No. PCT/EP2008/050615 filed Jan. 21, 2008, which designates the United States of America, and claims priority to German Application No. 10 2007 003 243.0 filed Jan. 23, 2007, the contents of which are hereby incorporated by reference in their entirety.

TECHNICAL FIELD

The present invention relates to a controlling arrangement for a rolling stand. It also relates to a computer program for a software-programmable controlling arrangement for a rolling stand. Furthermore, the present invention relates to a rolling arrangement. Finally, the present invention relates to a rolling mill with a number of rolling arrangements.

BACKGROUND

Various controlling arrangements for rolling stands are known. The most important controlling arrangements are roll gap controls and rolling force controls. A prerequisite for both controls is that the actuating element by means of which the roll gap of the rolling stand can be set is adjustable under load.

In the case of roll gap control, an actuating distance setpoint value is fed to a position controller. The actuating distance setpoint value is set such that the roll gap is suitably set. The actuating distance actual value is detected by means of a suitable detecting element and likewise fed to the position controller. From the values fed to it, the position controller determines a manipulated variable, on the basis of which the actuating distance of the actuating element can be changed, so that the actuating distance actual value is brought closer to the actuating distance setpoint value. The position controller outputs the manipulated variable to the actuating element.

During the rolling of the rolled stock, the rolling stand springs up on account of the rolling force exerted on the rolled stock. To compensate for this springing, it is known to detect the rolling force (more precisely: the rolling force actual value), to determine the springing of the rolling stand from the rolling force actual value and to correct the actuating distance setpoint value in such a way as to compensate for the springing of the rolling stand. If the rolling force increases, the actuating distance setpoint value is therefore changed in such a way that the correction of the actuating distance setpoint value counteracts the increase in the roll gap caused by the springing.

The controlling arrangement described above operates entirely satisfactorily if the rolls by means of which the rolled stock is rolled are exactly round and are mounted exactly centrally. However, these two conditions are not generally exactly ensured. There is therefore generally an eccentricity and/or an out-of-roundness. Only the eccentricity is discussed in more detail below. However, the problems entailed by out-of-roundness are equivalent to the problems entailed by eccentricity.

If, for example, the roll gap is reduced on account of an eccentricity, the rolled stock is rolled more strongly in the roll gap. An increased rolling force is required for this. If—in a way corresponding to the procedure described above for compensating for instances of springing of the rolling stand—the increased rolling force is interpreted as springing of the stand, the roll gap is reduced even further by the procedure described above, in addition to the reduction of the roll gap caused by the eccentricity. The eccentricity errors of the rolls are therefore imposed on the rolled stock to an increased extent. If the rolling force increases as a result of eccentricity, the actuating distance setpoint value must therefore be varied in such a way that the roll gap is opened up, in order to compensate for the eccentricity-induced reduction of the roll gap. The required variation of the actuating distance setpoint value in cases of eccentricity-induced rolling force changes is therefore diametrically opposed to the required changing of the actuating distance setpoint value that is attributable to other changes of the rolling force.

In the prior art, it is known in the case of a roll gap controller to determine the eccentricity of the rolls from the periodic fluctuations of, for example, the rolling force or the tension in the rolled stock upstream or downstream of the rolling stand under consideration, and to compensate for the eccentricity of the rolls by corresponding pre-control of the actuating distance setpoint value. Only the remaining fluctuation of the rolling force is regarded as springing of the rolling stand and is correspondingly corrected. It is of decisive significance in the case of this procedure that the changing of the actuating distance setpoint value brought about by eccentricity-induced changes of the rolling force on the one hand and brought about by changes of the rolling force due to other causes on the other hand are contrary. As already mentioned, the corresponding procedures are known. Purely by way of example, reference is made to U.S. Pat. Nos. 4,656,854 A, 4,222,254 A and 3,709,009 A.

In the case of rolling force control, a rolling force setpoint value and a rolling force actual value are fed to a rolling force controller. From the values fed to it, the force controller determines a manipulated variable, on the basis of which the actuating distance of the actuating element can be changed, so that the rolling force actual value is brought closer to the rolling force setpoint value.

In theory, an eccentricity of the rolls is not critical in the case of rolling force control. This is so because if, for example, an eccentricity briefly leads to a reduction in the roll gap, and consequently to an increase in the rolling force actual value, the actuating distance of the actuating element is changed in such a way that the roll gap is opened up, and therefore the rolling force actual value falls again.

In practice, however, the detection of the rolling force actual value is falsified by frictional forces which occur in the actuating element and in the rolling stand. Furthermore, the dynamics of the rolling force controls are too low, in particular at high rolling speeds, to compensate quickly enough for the eccentricity-induced rolling force fluctuations.

DE 198 34 758 A1 discloses a controlling arrangement for a rolling stand which has a force controller and a position controller. During the operation of the controlling arrangement, the force controller is fed a rolling force setpoint value and a rolling force actual value.

From the values fed to it, the force controller determines an actuating distance correction value. The actuating distance correction value and an actuating distance actual value of an actuating element are fed to the position controller. From the values fed to it, the position controller determines a manipulated variable, on the basis of which the actuating distance of the actuating element is changed. The manipulated variable is output to the actuating element.

SUMMARY

According to various embodiments, possibilities can be provided by means of which eccentricities can be effectively compensated even in the case of rolling force control.

According to an embodiment, in a controlling arrangement for a rolling stand, the controlling arrangement has a force controller and a position controller, which is subordinate to the force controller, during the operation of the controlling arrangement,—the force controller is fed a rolling force setpoint value and a rolling force actual value and, from the rolling force setpoint value and the rolling force actual value, the force controller determines an actuating distance correction value,—the actuating distance correction value, an eccentricity compensation value, which is different from the actuating distance correction value, and an actuating distance actual value of an actuating element are fed to the position controller,—from the values fed to it, the position controller determines a manipulated variable, on the basis of which the actuating distance of the actuating element is changed, and which is output to the actuating element, so that the controlling arrangement brings about force control of the rolling stand during operation.

According to a further embodiment, the force controller may have integral action, in particular is formed as a controller with an integral component. According to a further embodiment, in addition to the values that are the actuating distance correction value, eccentricity compensation value and actuating distance actual value, the position controller may be fed a basic actuating distance setpoint value during the operation of the controlling arrangement. According to a further embodiment, the position controller can be formed as a purely proportional controller. According to a further embodiment, the controlling arrangement may have a rolling force actual value determinator, to which variables that are characteristic of the rolling force actual value are fed to the controlling arrangement during operation and by which the rolling force actual value is determined from the characteristic variables. According to a further embodiment, the controlling arrangement can be formed as a software-programmable controlling arrangement and the force controller and the position controller can be realized as software blocks. According to a further embodiment, the rolling force actual value determinator may also be realized as a software block.

According to another embodiment, a computer program for a controlling arrangement as described above may comprise machine code which can be executed directly by the controlling arrangement and the execution of which by the controlling arrangement may have the effect that the controlling arrangement realizes a force controller and a position controller, which act as described above.

According to a further embodiment, the execution of the machine code by the controlling arrangement additionally may bring about the effect that the controlling arrangement realizes a rolling force actual value determinator, wherein the controlling arrangement has a rolling force actual value determinator, to which variables that are characteristic of the rolling force actual value are fed to the controlling arrangement during operation and by which the rolling force actual value is determined from the characteristic variables.

According to yet another embodiment, a data carrier with a computer program as described above may be stored on the data carrier in a machine-readable form.

According to yet another embodiment, a rolling arrangement may have a rolling stand, wherein the rolling stand has an actuating element, by means of which a roll gap of the rolling stand can be set under load, wherein the rolling stand has detecting elements, by which an actuating distance actual value of the actuating element is detected during the operation of the rolling arrangement and at least one first variable that is characteristic of a rolling force actual value with which a rolled stock is rolled in the roll gap of the rolling stand during the operation of the rolling arrangement is detected, and a controlling arrangement as described above and wherein during the operation of the rolling arrangement, the at least one first variable or a rolling force actual value derived from the first variable is fed to the force controller of the controlling arrangement, the actuating distance actual value is fed to the position controller of the controlling arrangement and the manipulated variable determined by the position controller of the controlling arrangement is output to the actuating element.

According to yet another embodiment, a rolling mill may comprise a number of rolling arrangements that are passed through one after the other by a rolled stock during the operation of the rolling mill, wherein the rolling arrangement that is passed through last by the rolled stock during the operation of the rolling mill is formed as described above.

BRIEF DESCRIPTION OF THE DRAWINGS

Further advantages and details emerge from the following description of an exemplary embodiment in conjunction with the basic drawing, in which.

DETAILED DESCRIPTION

Figure 1:
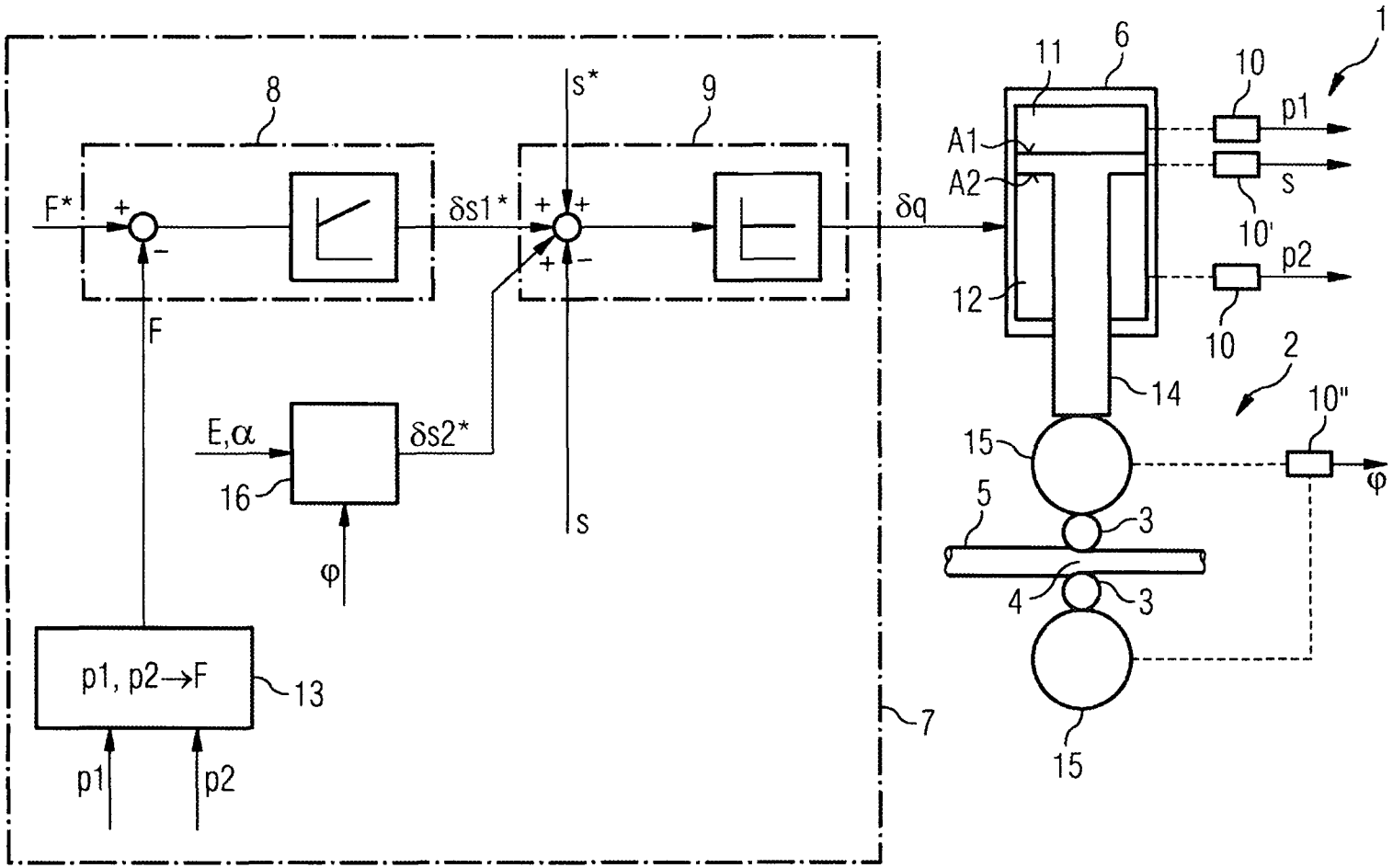
FIG. 1 shows a rolling arrangement according to an embodiment.

According to various embodiments, the controlling arrangement has a force controller and a position controller, which is subordinate to the force controller. During the operation of the controlling arrangement, the force controller is fed a rolling force setpoint value and a rolling force actual value. From the rolling force setpoint value and the rolling force actual value, the force controller determines an actuating distance correction value. The actuating distance correction value, an eccentricity compensation value, which is different from the actuating distance correction value, and an actuating distance actual value of an actuating element are fed to the position controller. From the values fed to it, the position controller determines a manipulated variable, on the basis of which the actuating distance of the actuating element is changed. The manipulated variable is output by the position controller to the actuating element. The components of the controlling arrangement interact in such a way that the controlling arrangement brings about force control of the rolling stand during operation.

If the controlling arrangement is software-programmable, the computer program according to an embodiment comprises machine code which can be executed directly by the controlling arrangement. The execution of the machine code by the controlling arrangement has the effect that the controlling arrangement realizes a force controller and a position controller, the two controllers acting in the way described above. The computer program may be stored on a data carrier.

According to various embodiments, the rolling arrangement has a rolling stand. The rolling stand has an actuating element, by means of which a roll gap of the rolling stand can be set under load. The rolling stand has detecting elements, by which an actuating distance actual value of the actuating element is detected during the operation of the rolling arrangement and at least one first variable that is characteristic of a rolling force actual value with which a rolled stock is rolled in the roll gap of the rolling stand during the operation of the rolling arrangement is detected. The rolling arrangement also has a controlling arrangement, such as that described above. During the operation of the rolling arrangement, the at least one first variable or a rolling force actual value derived from the first variable is fed to the force controller of the controlling arrangement. The actuating distance actual value is fed to the position controller of the controlling arrangement. The manipulated variable determined by the position controller of the controlling arrangement is output to the actuating element.

The rolling arrangement according to various embodiments may be used in particular in a rolling mill which has a number of rolling arrangements that are passed through one after the other by a rolled stock during the operation of the rolling mill. In principle, the rolling arrangement according to various embodiments may in this case be any of the rolling arrangements of the rolling mill. However, the rolling arrangement according to various embodiments is generally the rolling arrangement that is passed through last by the rolled stock during the operation of the rolling mill.

The procedure according to various embodiments has the effect that the eccentricity of the rolls of the rolling stand can be compensated by corresponding pre-control of the actuating element, although the controlling arrangement ultimately brings about a force control of the rolling stand.

The force controller preferably has integral action. In particular, it may be formed as a controller with an integral component. By this configuration, the force controller operates particularly effectively.

In addition to the values that are the actuating distance correction value, eccentricity compensation value and actuating distance actual value, it is possible to feed the position controller a basic actuating distance setpoint value during the operation of the controlling arrangement. This procedure has the effect that the actuating element is set at least substantially to a meaningful initial value already at the beginning of the operation of the rolling arrangement.

The position controller is preferably formed as a purely proportional controller. By this configuration, higher-quality control of the rolling force is obtained.

It is possible to feed the controlling arrangement the rolling force actual value directly as such. Alternatively, the controlling arrangement may have a rolling force actual value determinator, to which variables that are characteristic of the rolling force actual value are fed to the controlling arrangement during operation. In this case, the rolling force actual value is determined by the rolling force actual value determinator from the characteristic variables.

The controlling arrangement may be formed as a software-programmable controlling arrangement. In this case, the force controller and the position controller are realized as software blocks. If the controlling arrangement has the aforementioned rolling force actual value determinator, the rolling force actual value determinator is also preferably formed as a software block.

With respect to the computer program, the execution of the machine code by the controlling arrangement preferably brings about the effect that the controlling arrangement also realizes the rolling force actual value determinator.

The computer program may, in particular, take the form of a computer program product.

According to FIG. 1, a rolling arrangement 1 has a rolling stand 2. According to FIG. 1, the rolling stand 2 is formed as a four-high stand. However, the configuration of the rolling stand 2 as a four-high stand is of minor significance within the scope of the present invention.

The rolling stand 2 has work rolls 3. The work rolls 3 form a roll gap 4 between them. In the roll gap 4, a rolled stock 5 is rolled. The rolling operation may be cold rolling or hot rolling.

According to FIG. 1, the rolled stock 5 is a strip, in particular a metal strip. However, the rolled stock 5 may alternatively have some other form, for example take the form of a rod or tube.

The rolled stock 5 may consist, for example, of steel, aluminum or copper. Alternatively, the rolled stock 5 may—irrespective of its form—consist of some other material, for example of plastic.

The roll gap 4 can be set by means of an actuating element 6. According to FIG. 1, the actuating element 6 is formed as a hydraulic cylinder unit. However, the formation as a hydraulic cylinder unit is of minor significance. What is decisive is that the actuating element 6 can be adjusted not only in the load-free state, but also under load, that is to say while the rolled stock 5 is being rolled in the roll gap 4.

The rolling arrangement 1 also has a controlling arrangement 7. During the operation of the rolling arrangement 1, the rolling stand 2 is controlled by the controlling arrangement 7. For this purpose, the controlling arrangement 7 has a force controller 8 and a position controller 9. The position controller 9 is subordinate here to the force controller 8. During the operation of the rolling arrangement 1 (or during the operation of the controlling arrangement 7), the rolling stand 2 (including its actuating element 6) and the controlling arrangement 7 operate as follows:

A rolling force setpoint value F* and a rolling force actual value F are fed to the force controller 8. The rolled stock 5 is rolled in the roll gap 4 of the rolling stand 2 with a rolling force corresponding to the rolling force actual value F.

The rolling force setpoint value F* may, for example, be generated by the controlling arrangement 7 by means of an internal rolling force setpoint value determinator. However, the rolling force setpoint value determinator is not represented in FIG. 1. Alternatively, the rolling force setpoint value F* may be fed to the controlling arrangement 7 from the outside.

The rolling force actual value F must be directly or indirectly detected by means of suitable detecting elements 10. According to FIG. 1, for example, characteristic variables p1, p2 are detected and used to derive the rolling force actual value F. For example, pressures p1, p2 prevailing in working chambers 11, 12 of the hydraulic cylinder unit 6 are detected as characteristic variables p1, p2. According to FIG. 1, the detected characteristic variables p1, p2 are fed to a rolling force actual value determinator 13. From the characteristic variables p1, p2 fed to it, the rolling force actual value determinator 13 determines the rolling force actual value F and passes the rolling force actual value F on to the force controller 8. In the case of the configuration according to FIG. 1, the rolling force actual value determinator 13 can determine in particular the rolling force actual value F according to the relationship $$F=p1A1-p2A2,$$

where A1 and A2 are the areas A1, A2 of a piston 14 of the hydraulic cylinder unit 6 that bound the working chambers 11, 12 of the hydraulic cylinder unit 6. If the actuating element 6 were formed differently, the rolling force actual value F could, however, also be detected or determined in some other way. In particular, it is possible to detect the rolling force actual value F directly by means of a load cell. This procedure is possible irrespective of whether or not the actuating element 6 is realized as a hydraulic cylinder unit. In this case, the force controller 8 is fed the detected variable directly, since the detected variable in this case corresponds directly to the rolling force actual value F.

The force controller 8 determines from the rolling force setpoint value F* and the rolling force actual value F an actuating distance correction value δs1*. The force controller 8 feeds the actuating distance correction value δs1* to the position controller 9.

The position controller 9 accepts the actuating distance correction value δs1*. As further input values, the position controller 9 also accepts an actuating distance actual value s and an eccentricity compensation value δs2*. Furthermore, the position controller 9 may be additionally fed a basic actuating distance setpoint value s*. However, this is only optionally the case.

From the values fed to it, δs1*, δs2*, s and optionally s*, the position controller 9 determines a manipulated variable δq. The manipulated variable δq is output by the position controller 9 to the actuating element 6. The actuating distance of the actuating element 6 is changed on the basis of the manipulated variable δq. In the case of the configuration of the actuating element 6 as a hydraulic cylinder unit, the manipulated variable δq may be, for example, an amount of oil that is pumped per unit of time by an oil pump that is not represented into the working chamber 11 of the hydraulic cylinder unit, or let out of it.

The actuating distance actual value s is detected by means of a suitable detecting element 10' known per se of the rolling arrangement 1 and fed by this detecting element 10' to the position controller 9. Such detecting elements 10' are generally known.

The eccentricity variation can be determined within the controlling arrangement 7 independently. Corresponding detecting devices are known in the prior art, see, for example, the aforementioned U.S. Pat. Nos. 4,656,854, 4,222,254 and 3,709,009. Alternatively, the eccentricity variation may be fed to the controlling arrangement 7 from the outside. What is decisive is that variables E, α, which describe the variation in the eccentricity, are known to the controlling arrangement 7. The variables may be, for example, an amplitude E of th e eccentricity and a phase position α of the eccentricity. The phase position α may optionally be a vector which includes for each of the rolls 3, 15 of the rolling stand 2 an own frequency and an own individual phase position, that is to say both for each of the work rolls 3 and for each of the backing rolls 15.

According to FIG. 1, a corresponding angle position ϕ of the rolls 3, 15 of the rolling stand 2 is detected by means of a further detecting element 10". The angle position ϕ (which by analogy with the phase position α may be a vector) is fed to a compensation value determinator 16. The compensation value determinator 16 determines from the variables fed to it, E, α, ϕ, the eccentricity compensation value δs2* in a way known per se and feeds it to the position controller 9.

Other methods for determining the eccentricity compensation value δs2*—in conjunction with roll gap controls—are also known in the prior art. For example, it is known to determine (at least) a frequency of the eccentricity (and consequently also of the eccentricity compensation value δs2*) from the speed of the drive motor for the work rolls 3 and to correct the amplitude and phase position of the variation over time of the eccentricity compensation value δs2* until the eccentricity is completely eliminated by the control. Which method is used for determining the eccentricity compensation value δs2* is at the discretion of a person skilled in the art. What is decisive is that the compensation value determinator 16 correctly determines the respective eccentricity compensation value δs2* and feeds it to the position controller 9.

The force controller 8 operates in such a way that, with a constant rolling force setpoint value F*, it keeps correcting the actuating distance correction value δs1* until the rolling force actual value F corresponds to the rolling force setpoint value F*. In particular, if there is an increase in the rolling force actual value F, the force controller 8 does not make the work rolls 3 of the rolling stand 2 move toward one another, as would be the case when compensating for springing of the rolling stand 2. Rather, in such a case the force controller 8 makes the work rolls 3 open up, in order to adapt the rolling force actual value F to the rolling force setpoint value F*.

The force controller 8 should preferably have integral action. For this purpose, the force controller 8 may, for example, be formed as an I controller, as a PI controller or as a PID controller. The abbreviations P, I and D stand here for the conventional designations proportional, integral and differential. The force controller 8 may alternatively also be formed as a different controller with an integral component. The position controller 9 is preferably formed as a purely P controller. It may comprise compensation for a zero-point error and linearization of the actuating element behavior.

Figure 2:
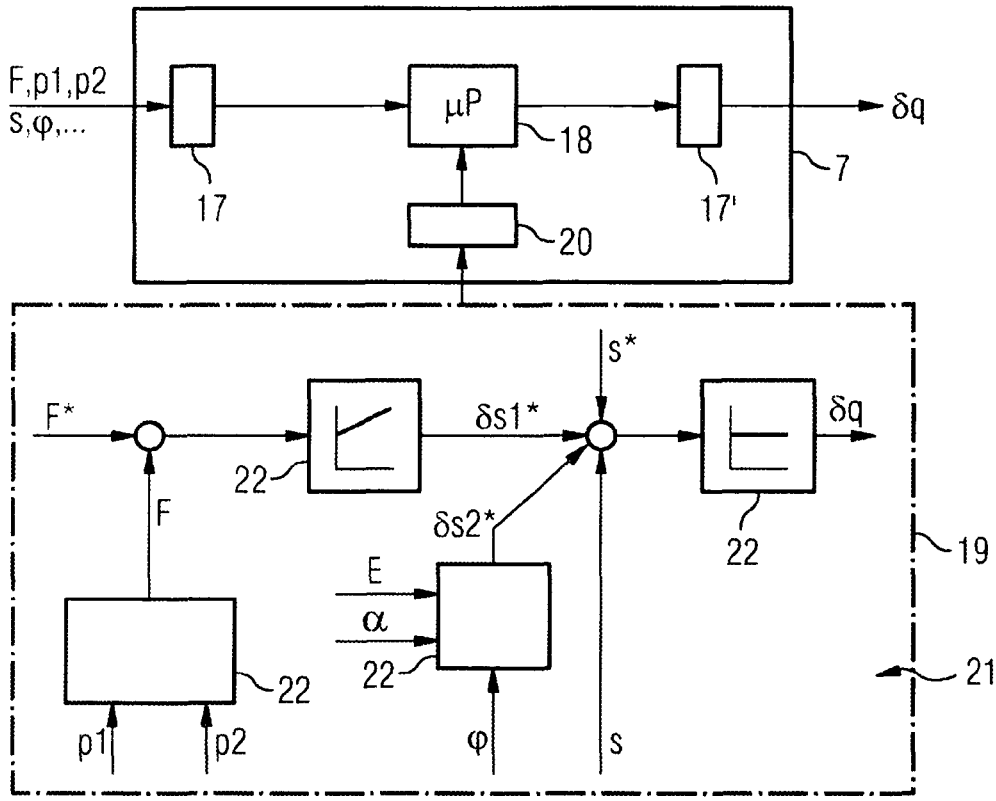
FIG. 2 shows a possible configuration of a controlling arrangement and FIG. 3 shows a rolling mill.

The controlling arrangement 7 according to various embodiments may be formed as a hardware circuit. However, the controlling arrangement 7 according to FIG. 2 is preferably formed as a software-programmable controlling arrangement. The controlling arrangement 7 therefore has an input device 17, by means of which at least the actuating distance actual value s and at least one further variable are fed to the controlling arrangement 7. The at least one further variable is either the rolling force actual value F or at least one variable p1, p2 from which the rolling force actual value F can be derived. Where required, further values, for example the rolling force setpoint value F*, the basic actuating distance setpoint value s* or the variables E, α, which describe the eccentricity, may be fed to the controlling arrangement 7 by means of the input device 17 that is represented in FIG. 2 or some other input device that is not represented in FIG. 2.

The controlling arrangement 7 of FIG. 2 also has a computing unit 18, for example a microprocessor. The computing unit 18 processes a computer program 19, which is stored in a storage device 20 of the controlling arrangement 7. The storage device 20 of the controlling arrangement 7 corresponds to a data carrier as provided by the various embodiments.

The computer program 19 comprises machine code 21, which can be executed directly by the controlling arrangement 7. The execution of the machine code 21 by the controlling arrangement 7 has the effect that the controlling arrangement 7 realizes at least the force controller 8 and the position controller 9 as software blocks 22. If the controlling arrangement 7 has further components, for example the rolling force actual value determinator 13 and/or the compensation value determinator 16, the execution of the machine code 21 by the controlling arrangement 7 preferably also brings about the realization of these components 13, 16 as software blocks 22. The force controller 8 realized as software block 22, the position controller 9 realized as software block 22, and optionally the further components 13, 16 of the controlling arrangement 7 realized as software blocks 22, act of course in the way described in detail above in conjunction with FIG. 1. In particular, the computing unit 18 determines the manipulated variable δq and outputs it to the actuating element 6 by means of an output device 17'.

Figure 3:
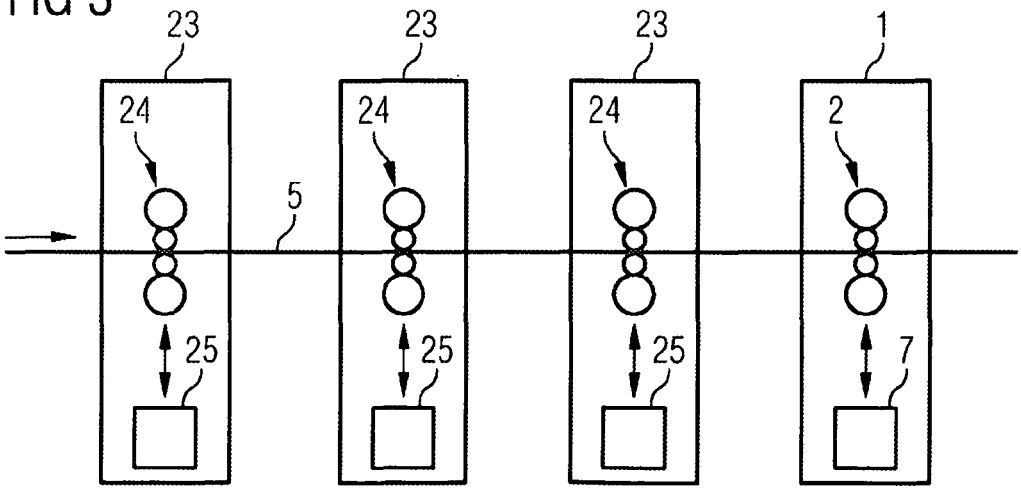

A rolling mill is now described in conjunction with FIG. 3. According to FIG. 3, the rolling mill has a number of rolling arrangements 1, 23. Each rolling arrangement 1, 23 has a rolling stand 2, 24, which is controlled by a controlling arrangement 7, 25 assigned to the respective rolling arrangement 1, 23. The rolling arrangements 1, 23 of the rolling mill are passed through by the rolled stock 5 one after the other during the operation of the rolling mill. The rolling stand 2 that is passed through last by the rolled stock 5 is often formed as what is known as a sizing stand. At least the rolling arrangement 1 that is passed through last by the rolled stock 5 during the operation of the rolling mill is preferably formed in a way corresponding to FIG. 1 and is operated in the way explained in detail above in conjunction with FIG. 1. Alternatively or in addition, however, it is also possible for at least one other rolling arrangement 23 of the rolling mill to be formed in a way corresponding to FIG. 1 and operated in a way corresponding to FIG. 1.

With the procedure according to various embodiments, superior force-controlled operation of the rolling arrangement 1 can be achieved. In particular, eccentricities can be eliminated by the control considerably better than is possible in the prior art.

The above description serves exclusively for explaining the present invention. On the other hand, the scope of the present invention is to be determined exclusively by the appended claims.

The invention claimed is:

1. A controlling arrangement for a rolling stand including an actuating element, the controlling arrangement comprising:

a force controller; and a position controller subordinate to the force controller;

wherein the force controller determines an actuating distance correction value based at least in part on a rolling force setpoint value and a rolling force actual value;

wherein the position controller determines a manipulated variable based at least in part on the actuating distance correction value, an eccentricity compensation value, and an actuating distance actual value of the actuating element;

wherein a new value for the actuating distance of the actuating element is calculated based at least in part on the manipulated variable determined by the position controller; and the position controller communicates the new value for the actuating distance of the actuating element to the actuating element of the rolling stand.

2. The controlling arrangement according to claim 1, wherein the force controller includes an integral component.

3. The controlling arrangement according to claim 1, wherein the position controller determines the manipulated variable based at least in part on a basic actuating distance setpoint value.

4. The controlling arrangement according to claim 1, wherein the position controller includes a purely proportional controller.

5. The controlling arrangement according to claim 1, further comprising a rolling force actual value determinator determining the rolling force actual value during operation of the rolling mill.

6. The controlling arrangement according to claim 1, further comprising a software-programmable controlling arrangement wherein the force controller and the position controller comprise software blocks.

7. The controlling arrangement according to claim 5, wherein the rolling force actual value determinator includes a software block.

8. A rolling arrangement comprising:

a rolling stand including an actuating element;

the actuating controlling a roll gap of the rolling stand while operating under load; and detecting elements sensing an actuating distance actual value of the actuating element;

the detecting elements further sensing a first variable characteristic of a rolling force actual value with which a rolled stock is rolled in the roll gap of the rolling stand during the operation of the rolling arrangement;

a controlling arrangement including a force controller and a position controller subordinate to the force controller;

wherein the force controller determines an actuating distance correction value based at least on a rolling force setpoint value and rolling force actual value; and wherein the position controller determines a manipulated variable at least in part on the actuating distance correction value, an eccentricity compensation value, and an actuating distance actual value of an actuating element; and wherein the actuating element adjusts the roll gap based at least in part on the manipulated variable.

9. A method of operating a rolling arrangement including a rolling stand having an actuating element controlling a roll gap of the rolling stand, the method comprising the steps of:

detecting an actual value of an actuating distance of the actuating element during the operation of the rolling arrangement;

detecting at least one metric characteristic of an actual value of a rolling force with which a rolled stock is rolled in the gap of the rolling stand during the operation of the rolling arrangement;

feeding a force controller with a rolling force setpoint value and a rolling force actual value;

determining an actuating distance correction value based at least in part on the rolling force setpoint value and the actual value of the rolling force;

feeding a position controller with the actuating distance correction value, an eccentricity compensation value, and the actual value of the actuating distance of the actuating element;

determining a manipulated variable based at least in part on the actuating distance correction value, the eccentricity compensation value, and the actual value of the actuating distance of the actuating element;

changing the actuating distance of the actuating element based at least in part on the manipulated variable.

10. The method according to claim 9, wherein determining the manipulated variable further depends at least in part on a basic actuating distance setpoint value.

11. The method according to claim 9, wherein the position controller operates as a purely proportional controller.

12. The method according to claim 9, wherein detecting the at least one metric characteristic of the actual value of the rolling force with which a rolled stock is rolled in the roll gap of the rolling stand includes using a rolling force actual value determinator, relying on variables characteristic of the rolling force actual value fed to the controlling arrangement during operation.

* * * * *